United States Patent [19]

Singarayer

[11] Patent Number: 4,853,599

[45] Date of Patent: Aug. 1, 1989

[54] CYCLING LIMITING CIRCUITRY AND METHOD FOR ELECTRICAL APPARATUS

[75] Inventor: Santiago Singarayer, Southaven, Miss.

[73] Assignee: FL Industries, Inc., Livingston, N.J.

[21] Appl. No.: 155,123

[22] Filed: Feb. 11, 1988

[51] Int. Cl.[4] ..... H05B 37/03

[52] U.S. Cl. ..... 315/119; 315/127

[58] Field of Search ..... 315/119, 127, 307, 308, 315/310, 363, DIG. 167

[56] References Cited

U.S. PATENT DOCUMENTS 4,727,297 2/1988 Wolze ..... 315/307

*Primary Examiner*—David Mis

*Attorney, Agent, or Firm*—Elliot M. Olstein; Raymond J. Lillie; Jeremiah G. Murray

[57] ABSTRACT

For use with apparatus of the type including a power supply, means operated by the power from the power supply and means operably connected between the power supply and the means operated thereby for applying power of a predetermined magnitude for operating said operated means circuitry and method wherein a resistor is connected to the apparatus and cycling limiting circuitry is connected across the resistor and is responsive to the voltage drop thereacross when the operated means cycles, i.e. turns off and then on. The cycling limiting circuitry counts the number of cycles and after a predetermined number of cycles occurs provides an output which is effective for interrupting power from the power supply, whereby the operating means is removed from the circuit to protect the latter from damage due to unlimited cycling.

18 Claims, 3 Drawing Sheets

CYCLING LIMITING CIRCUITRY AND METHOD FOR ELECTRICAL APPARATUS

BACKGROUND OF THE INVENTION

This invention relates to electrical apparatus of the type including a power source, means operated by the power source, and means operatively connected between the power source and the means operated thereby for applying power of a predetermined magnitude to said operated means for operating same.

Apparatus of the type described is subject to cycling. That is to say, under certain operating conditions the operated device will become inoperative for an interval during which the conditions are alleviated so that the operating device is again operative. Cycling can present a severe maintenance problem since, among other things, the power applying means can deteriorate or burn out if the cycling persists.

Apparatus particularly prone to the adverse effects of cycling includes that for operating high pressure sodium lamps. This apparatus includes the lamp and a ballast-starter arrangement connected to a source of electrical power and operative for supplying voltage to the lamp to operate the latter. The operating characteristics of the sodium lamp are such that as the lamp ages some of its electrode material deposits on the arc tube of the lamp. This causes the arc tube to retain heat and, in turn, the internal lamp pressure and the arc tube voltage will increase. When the arc tube voltage becomes so high that the ballast can no longer support the arc tube, the lamp goes out. The lamp will re-light after it has cooled down sufficiently, and hence alternately cycles between lighted and extinguished conditions.

Accordingly, in order to avoid maintenance problems occurring because of a deterioration or burn-out of the ballast-starter arrangement due to cycling it is desirable, if not necessary to turn off power to the lamp when the lamp cycles more than a selected number of times.

Prior art devices attempt to accomplish this in several ways, for example, the voltage across the lamp or across the ballast-starter arrangement may be measured and power to the lamp may be monitored on the basis of this measurement. Also, monitoring circuitry can be included to determine if the ballast-starter arrangement is operating properly.

The present invention is aware of U.S. Pat. No. 4,207,500 issued on June 10, 1980 to George Duve, et al and assigned to Area Lighting Research Inc., Hackettstown, N.J.; U.S. Pat. No. 4,473,779 issued on Sept. 25, 1984 to Larry A. Lindner, et al and assigned to the same assignee; and U.S. Pat. No. 4,665,346 issued on May 12, 1987 to Pierre Tarroux and assigned to Europhane, Paris, France.

The Duve patent teaches an arrangement including sensor means for detecting the magnitude of the voltage across the extinguished lamp, and for generating an electrical current signal when the magnitude of the voltage across the lamp reaches a threshold magnitude which is greater than a predetermined magnitude. Means are responsive to the current signal for disconnecting the power source from the ballast-starter arrangement to thereby protect the latter from damage in the event of a cycling malfunction.

The Lindner patent recognizes that the power factor of an extinguished lamp-ballast-starter combination during cycling is different than that when the lamp is operative. Hence, the Lindner invention teaches sensor means for detecting the power factor across the lamp-ballast-starter combination and for generating a cut-off signal when the detected power factor is different from a predetermined power factor for disconnecting the power source from the ballast-starter arrangement to likewise protect the latter in the event of excessive cycling.

The Tarroux patent teaches operating a starting circuit for a predetermined interval in response to a control signal which is generated either following the application of a voltage to the input terminals of a lamp circuit at the beginning of a working period of said circuit, or a pre-determined delay following interruption of said voltage due to a short power interruption. The operation of the starting circuit is inhibited if the lamp extinguishes due to an increase in its operating voltage. Thus, attempts to re-start a defective lamp are avoided.

The present invention differs from the prior art in that a resistor with very low resistance value is included in the lamp-ballast circuit. The voltage across the resistor drops when the lamp changes from a lighted to an extinguished condition, i.e. when the lamp cycles. This change in voltage level is indicated by a comparator as a cycle which is counted and power to the lamp circuit is interrupted after a predetermined number of cycles occur. Thus, the cycling phenomenon is limited to protect deterioration of the ballast-starter arrangement as is desirable.

SUMMARY OF THE INVENTION

This invention contemplates cycling limiting circuitry and method for electrical apparatus of the type including a power source, means operated by power from the power source and means operatively connected between the power source and the means operated thereby for applying power of a predetermined magnitude for operating said operated means. A resistor is connected to the apparatus and cycling limiting circuitry is connected across the resistor and is responsive to the voltage drop which occurs when the operated means cycles. The cycling limiting circuitry counts the number of cycles, and after a predetermined number of cycles said circuitry provides an output which is effective for interrupting power from the power source whereby the operating means is removed from the circuit to protect the latter from damage due to unlimited cycling.

DETAILED DESCRIPTION OF THE INVENTION

Figure 1:
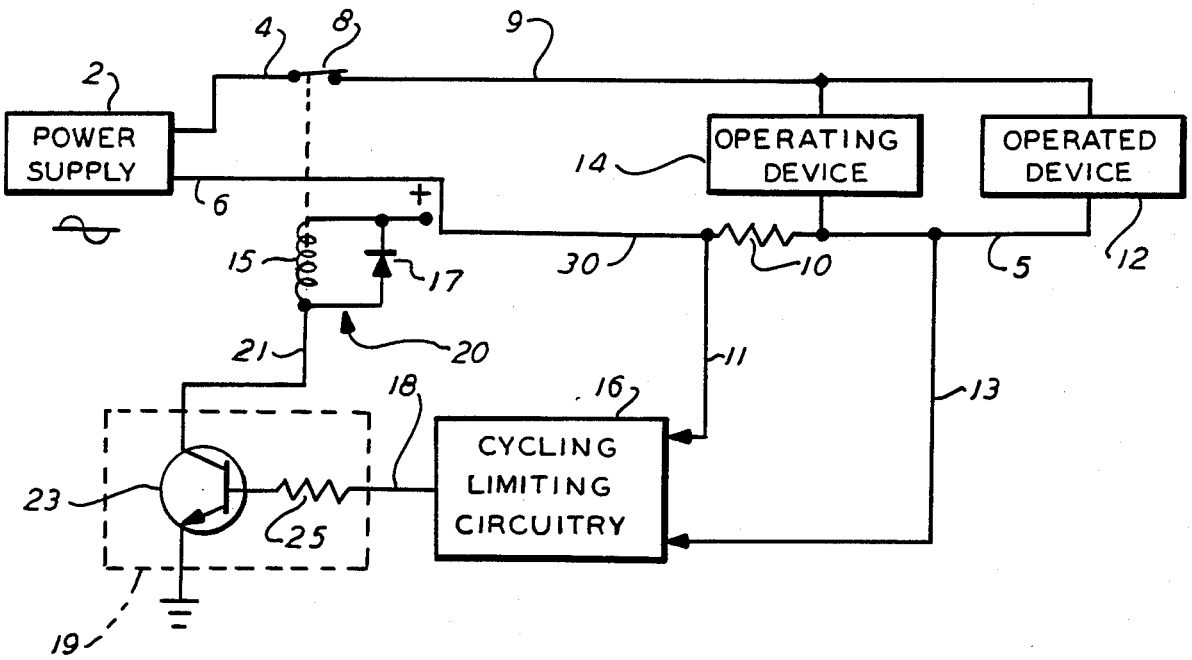
FIG. 1 is a block diagram generally illustrating the invention.

With reference first to FIG. 1, an AC power source is designated by the numeral 2. Power supply 2 is a conventional AC power source such as provides a 120 volt AC output across conductors 4 and 6 Conductor 4 is connected to a normally closed switch 8 and conductor 6 is connected to a resistor 10. An operated device 12 and an operating device 14 are connected across conductors 9 and 5. Device 14 is operative for applying power of a predetermined magnitude to operated device 12 for operating said device 12.

Although operated device 12 will be hereinafter described as a high pressure sodium lamp, it may be any type of device which consumes electrical current. Device 12 may thus be an AC or DC motor, a heater or any other like device subject to cycling under certain operating conditions such as heretofore described.

Cycling limiting circuitry designated by the numeral 16 is connected across resistor 10 via conductors 11 and 13. Cycle limiting circuitry 16 is effective for determining the voltage drop across resistor 10 each time operated device 12 cycles, i.e. alternately turns on and off, and counts the number of cycles. The cycle limiting circuitry provides an output (logic "high") at an output conductor 18 when a predetermined number of cycles have been counted as will be hereinafter described. The output provided by cycle limiting circuitry 16 energizes a relay 20 through relay driver 19. Relay driver 19 includes a transistor 23 and resistor 25 connected between the base of transistor 23 and the conductor 18. The emitter of transistor 23 is grounded and the collector is connected to relay 20 via conductor 21. Transistor 23 is normally not conducting and is turned on by the "high" output from cycle limiting circuitry 16. This action will energize relay 20 and open switch 8, thereupon removing power from power supply 2 to operating device 14 and operated device 12 to protect the operating device 14 against repetitive cycling of operated device 12.

Relay 20 includes a relay coil 15 coupled to switch 8 and a diode 17. Diode 17 is present to minimize the inductive kick produced by the relay coil 15.

Figure 2:
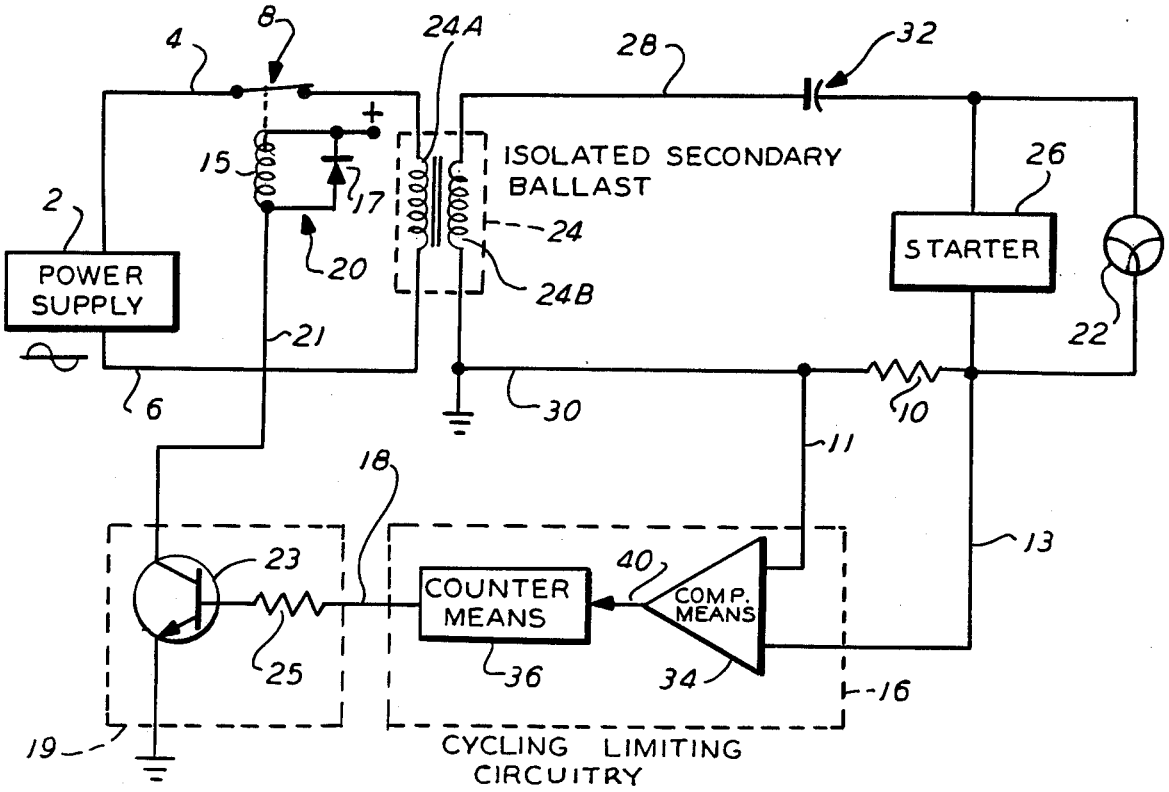
FIG. 2 is a combination electrical schematic-block diagram generally illustrating the invention in terms of one embodiment thereof including a high pressure lamp circuit with an isolated secondary ballast arrangement.

With reference to FIG. 2, the invention is described relative to operating a high pressure sodium lamp 22 and includes an isolated secondary ballast 24 and a starter 26. Isolated secondary ballast 24 includes a primary winding 24A and inductively coupled secondary winding 24B. Primary winding 24A is connected at one of its legs to switch 8 and at the other of its legs to conductor 6. Secondary winding 24B is connected at one of its legs to a conductor 28 and at the other of its legs to ground and to a conductor 30. Conductor 28 is connected through a capacitor 32 to one terminal of lamp 22 and to one terminal of starter 26. Conductor 30 is connected through resistor 10 to another terminal of lamp 22 and to another terminal of starter 26. Accordingly, lamp 22 and starter 26 are connected in parallel.

Cycle limiting circuitry 16 includes comparator means 34 and counter means 36. Resistor 10 converts the lamp operating AC current to an AC voltage. This voltage is rectified as will be hereinafter described with reference to FIG. 3 to obtain a DC voltage proportional to the AC current.

Comparator means 34 is connected across resistor 10 via conductors 11 and 13 and is set at one terminal thereof to a reference voltage provided as will also be hereinafter described with reference to FIG. 3. When the voltage at the other input terminal of comparator means 34 goes below this reference voltage, comparator means 34 provides an output at an output conductor 40 thereof which is applied to counter means 36. With the arrangement shown, the comparator means output at conductor 40 is indicative that lamp 22 has cycled, i.e. alternately turns on and off for any reason. When lamp 22 cycles a predetermined number of times as counted by counter means 36, the counter means 36 provides an output at an output conductor 18. This output is applied to relay driver means 19 which energizes relay 20 which opens normally closed switch 8 as heretofore indicated to remove ballast 24 from the lamp operating apparatus to protect the ballast from unlimited cycling.

Figure 3:
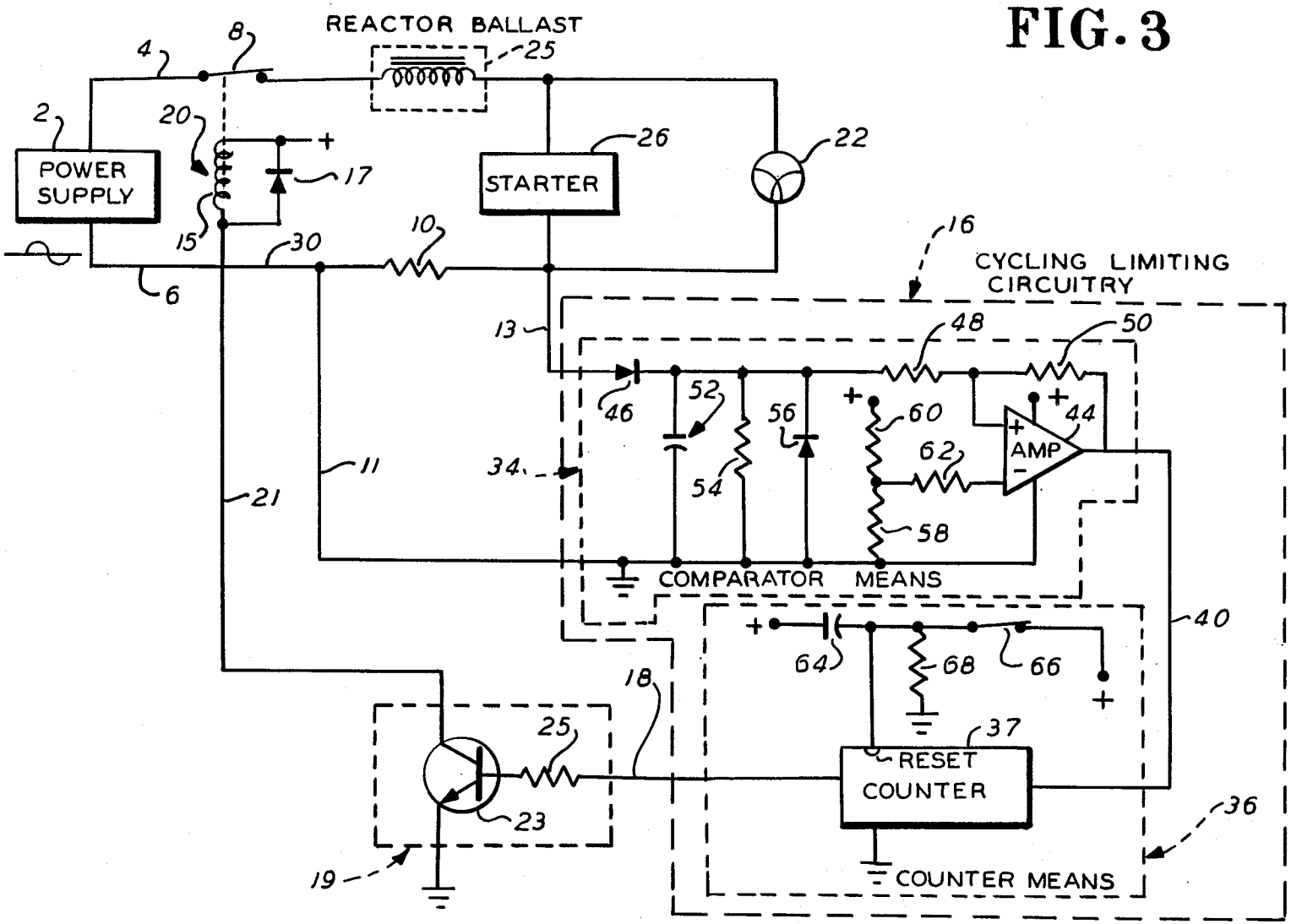
FIG. 3 is an electrical schematic diagram illustrating another embodiment of the invention in terms of a high voltage lamp circuit with a reactor ballast and showing the cycling limiting circuitry of the invention in substantial detail.

With reference to FIG. 3, a reactor ballast 25 is connected between switch 8 and starter 26. Lamp 22 and starter 26 are connected in parallel as described with reference to FIG. 2. Cycling limiting circuitry 16 is connected across resistor 10 via conductors 11 and 13 as also described with reference to FIG. 2.

Comparator means 34 includes an operational amplifier 44 having a non-inverting input terminal (+) and an inverting input terminal (−). Conductor 13 is connected to the non-inverting input terminal (+) of amplifier 44 through a steering diode 46, which permits only the positive half of the power supply output to pass, and through a resistor 48. A feedback resistor 50 is connected to the output terminal of amplifier 44 and to the non-inverting input terminal (+) thereof.

Conductor 11 is the common of the power supply and is connected to the common of the amplifier 44. A capacitor 52, a resistor 54 and a diode 56 are connected in parallel across conductors 11 and 13 after the diode 46. The diode 46 and capacitor 52 arrangement converts the AC voltage present across resistor 10 to a DC voltage. The resistor 54 bleeds the charge built up in the capacitor 52 when lamp 22 goes off so that there can be an energy build up from zero to another voltage level the next time the lamp goes on. Diode 56 is present to protect the circuit from any reverse voltage.

Resistors 58 and 60 are connected in such and connected between (+) DC voltage supply and ground such as, for example, a +12 volt DC supply. A resistor 62 is connected at the junction of resistors 58 and 60 and is connected to the inverting input terminal (−) of amplifier 44.

With the arrangement shown, resistors 58 and 60 act as a voltage divider and provide a reference voltage at the inverting input terminal (−) of amplifier 44. When lamp 22 cycles, a voltage drop occurs across resistor 10 and the voltage at the non-inverting input terminal (+) goes below the reference voltage. Amplifier 44 thereupon provides an output which is indicative of this voltage drop, and which output is at a logic "high" (1) level.

The output from amplifier 44 is applied through conductor 40 to counter 37 in counting means 36. Counter 37 may be a conventional and commercially available counter. The capacitor 64 and resistor 68 are connected in series. The free end of capacitor 64 is connected to the positive (+) DC voltage supply. The free end of resistor 68 is grounded. The junction of capacitor 64 and resistor 68 is connected to the reset of counter 37. A normally open switch 66 is connected between a (+) terminal and the reset of counter 37. The above connection provides a "power on" and a manual reset capability, for counter 37. The counter means 36 provides a logic "high" on conductor 18 when a predetermined number of counts has been achieved and opens switch 8 as previously described.

Figure 4:
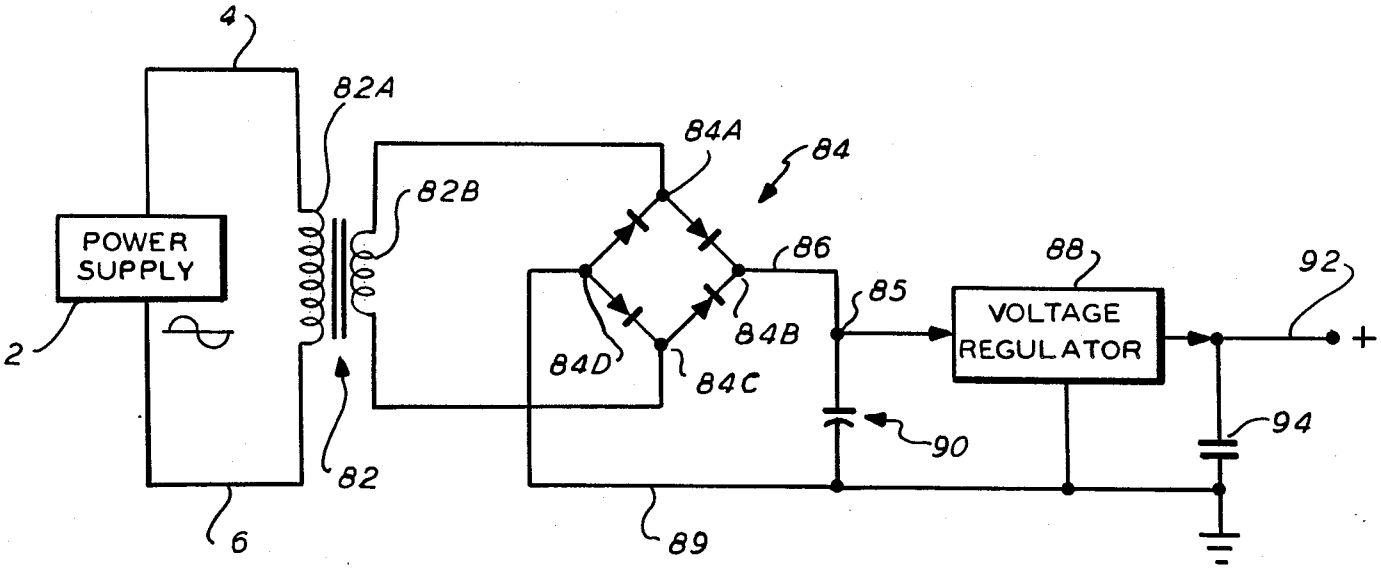
FIG. 4 is an electrical schematic diagram illustrating a power supply for supplying power to the cycling limiting circuitry.

In describing the circuit of FIG. 3 numerous references have been made to the positive voltage (+) DC voltage supply. FIG. 4 indicates the configuration of this voltage supply. Thus, a transformer 82 has a primary winding 82A connected to a suitable power supply which may be power supply 2 shown in FIGS. 1, 2 and 3. Transformer 82 includes an AC secondary winding 82B inductively coupled to primary winding 82A.

A diode bridge circuit is designated by the numeral 84 and has output terminals 84A, 84B, 84C and 84D. Bridge circuit output terminal 84A is connected to one leg of secondary winding 82B of transformer 82 and terminal 84C is connected to the other leg of the secondary winding 82B. Bridge circuit output terminal 84B is connected through a conductor 86 to the input terminal of a commercially available voltage regulator 88. Bridge output terminal 84D which is the ground of the power supply is connected through a conductor 89 to the ground terminal of the voltage regulator. Capacitor 90 is connected across voltage regulator input and ground. The output of the power supply is available at output conductor 92 of voltage regulator 88. Capacitor 94 is connected across the voltage regulator output 92 and ground. Voltage regulator 88 provides at output conductor 92 thereof a positive (+) DC voltage which may be applied to the several circuit points indicated in FIG. 3.

Even though there are many design techniques available to obtain a (+) DC voltage supply, a step down transformer 82 is used so that the DC power supply ground is isolated from conductor 6, of the AC power supply 2. If the DC power supply ground is not isolated, then, in FIG. 2, isolated secondary ballast will not be isolated from the primary.

There has thus been described cycling limiting circuitry and method for use with electrical apparatus of the type including a power supply, means such as a high voltage lamp operated by power from the power supply and means such as a ballast-starter arrangement operatively connected between the power supply and the lamp for applying power of a predetermined magnitude for operating the lamp. A resistor is connected to the apparatus. Cycling limiting circuitry is responsive to the voltage drop across the resistor upon the lamp cycling and includes comparator means for providing an output when the circuit cycles, counter means for counting the number of times the output is provided, and inverter means for actuating a relay to open the circuit when a predetermined number of counts has been reached. The arrangement as described protects the ballast-starter arrangement and associated circuitry from damage due to unlimited cycling.

With the above description of the invention in mind reference is made to the claims appended hereto for a definition of the scope of the invention.

What is claimed is:

1. In electrical apparatus of the type including means operated by said apparatus, a source of electrical power, and operating means connected to the power source and operative for applying a voltage across the operated means, circuitry for limiting the cycling of the operated means, wherein said means is alternately on and off, by disconnecting the operating means from the power source to protect the operating means when a cycling limit is reached, comprising:

normally closed switching means connecting the operating means to the power source;

a resistor connected to the power source and to the operated means, whereby a voltage drop occurs across the resistor upon the operating means cycling;

means connected across the resistor and responsive to the number of times the operated means cycles and providing an output when said means cycles a predetermined number of times; and means connected to the last mentioned means and to the switching means and responsive to the output from said last mentioned means for opening the switching means to disconnect the operating means from the power source.

2. Cycling limiting circuitry as described by claim 1, wherein the means connected across the resistor includes:

comparator means connected across the resistor and set to a reference voltage, and comparing the reference voltage to the voltage across the resistor and providing an output when the latter voltage drops below the reference voltage, said output being indicative of the cycling of the operated means;

counting means for counting the number of times the comparator means provides said output and for providing an output when a predetermined count is reached; and means connected to the counting means and responsive to the output therefrom for providing a controlling output.

3. Cycling limiting circuitry as described by claim 2, wherein:

the means for opening the switching means is connected to the means for providing a controlling output and is responsive to the controlling output therefrom for opening said switching means.

4. Cycling limiting circuitry as described by claim 3, wherein the comparator means includes:

an operational amplifier connected to the resistor for receiving the voltage thereacross;

a supply voltage source connected to the operational amplifier; and means connected between the resistor and the operational amplifier for converting an AC voltage across the resistor to a DC voltage.

5. Cycling limiting circuitry as described by claim 4, including:

the operational amplifier having a non-inverting input terminal connected to the means for converting an AC voltage to a DC voltage;

the operational amplifier having an inverting input terminal;

means connected to the inverting input terminal and to the supply voltage source for providing the reference voltage; and the operational amplifier having an output terminal at which the output indicative of the cycling of the operated means is provided.

6. Cycling limiting circuitry as described by claim 5, including:

feedback means connected to the output terminal and to the non-inverting input terminal of the operational amplifier.

7. Cycling limiting circuitry as described by claim 5, wherein the counting means includes:

a counter connected to the output terminal of the operational amplifier for counting the number of times the output indicative of the cycling of the operated means is provided thereat;

means for providing a reset capability connected to the counter and including a capacitor connected to the supply voltage source for providing a power reset capability and a normally open switch connected to the supply voltage and operator closable for providing a manual reset capability; and the counting means providing an output when the output indicative of the cycling of the operated means is provided a predetermined number of times.

8. Cycling limiting circuitry as described by claim 7, wherein:

the output provided at the output terminal of the operational amplifier and indicative of the cycling of the operated means is at a logic "high" level.

9. Cycling limiting circuitry as described by claim 8, wherein:

the output provided by the counting means and which output is indicative of the cycling of the operated means a predetermined number of times is at a logic "low" level.

10. Cycling limiting circuitry as described by claim 9, wherein the means connected to the counting means and responsive to the output therefrom for providing a controlling output includes:

means for inverting the output at the logic "low" level and for providing the controlling output at a logic "high" level.

11. Cycling limiting circuitry as described by claim 10, including:

means connected to the means for opening the switching means and to the voltage supply source for insuring that the controlling output received by the switch opening means is of a predetermined polarity.

12. Cycling limiting circuitry as described by claim 4, wherein the supply voltage source includes:

transformer means connected to the source of electrical power for providing an AC output of a predetermined magnitude;

rectifying means connected to the transformer means for rectifying the output therefrom and for providing a DC output; and voltage regulator means connected to the rectifying means for providing the supply voltage.

13. In electrical apparatus of the type including a high pressure sodium lamp, a source of electrical power and ballast-starter means operatively connected to the power source and to the lamp, said power source being normally operative for supplying power to the lamp and to the ballast-starter means to light the lamp, circuitry for limiting the cycling of the lamp, wherein the lamp is alternately on and off, to protect the ballast-starter means, comprising:

normally closed switching means connecting the ballast-starter means to the power source;

a resistor connected to the power source and to the lamp, whereby a voltage drop occurs across the resistor upon the lamp cycling;

means connected accoss the resistor and responsive to the number of time and lamp cycles and providing an output when said lamp cycles a predetermined number of times; and means connected to the last mentioned means and to the switching means and responsive to the output from said last mentioned means for opening the switching means to disconnect the ballast-starter means from the power source.

14. Cycling limiting circuitry as described by claim 13, wherein the means connected across the resistor includes:

comparator means connected across the resistor and set to a reference voltage, and comparing the reference voltage to the voltage across the resistor and providing an output at a first logic level when the voltage across the resistor drops below the reference voltage, said output being indicative of the cyling of the lamp;

counting means for counting the number of times the comparator means provides the output at the first logic level and for providing an output at a second logic level when a predetermined count is reached;

inverting means connected to the counting means and responsive to the output therefrom at the second logic level for providing an output at the first logic level; and the means for opening the switching means connected to the inverting means and responsive to the output therefrom at the first logic level for opening said switching means.

15. A method for protecting an operating means connected to a power source and operative for applying a voltage across an operated means, by limiting the cycling of the operated means, wherein said means is alternatively on and off, by disconnecting the power source from the operating means when a cycling limit is reached, comprising:

connecting a resistor to the power source and to the operated means;

comparing the voltage across the resistor to a reference voltage and providing an output when the voltage across the resistor drops below the reference voltage a predetermined number of times, said output indicating the cycling of the operated means the predetermined number of times; and utilizing the last mentioned output for disconnecting the power source from the operating means.

16. A method as described by claim 15, wherein providing an output indicating the cycling occurring a predetermined number of times includes:

counting the number of times said cycling occurs; and providing said output when a predetermined count is reached.

17. A method as described by claim 16, wherein utilizing said output for disconnecting the power source from the operating means includes:

inverting said output for providing a controlling output; and utilizing the controlling output for disconnecting the power source from the operating means.

18. A method for protecting ballast-starter means connected to a power source and operative for applying a voltage for turning on a high pressure sodium lamp, by limiting the cycling of the lamp, wherein said lamp is alternately on and off, by disconnecting the power source from the ballast-starter means when a cycling limit is reached, comprising:

connecting a resistor to the power source and to the lamp;

comparing the voltage across the resistor to a reference voltage and providing an output when the voltage across the resistor drops below the reference voltage, said output indicating the cycling of the lamp;

counting the number of times the cycling occurs and providing an output upon reaching a predetermined count; and utilizing the last mentioned output for disconnecting the power source from the operating means.

* * * * *

UNITED STATES PATENT AND TRADEMARK OFFICE

CERTIFICATE OF CORRECTION

PATENT NO. : 4,853,599

DATED : August 1, 1989

INVENTOR(S) : Singarayar

It is certified that error appears in the above-identified patent and that said Letters Patent is hereby corrected as shown below:

On the title page, item [75] should read --Singarayar--.

Signed and Sealed this

Thirty-first Day of July, 1990

*Attest:*

HARRY F. MANBECK, JR.

*Attesting Officer*

*Commissioner of Patents and Trademarks*